US010578270B2

(12) United States Patent
Aso

(10) Patent No.: US 10,578,270 B2
(45) Date of Patent: Mar. 3, 2020

(54) VEHICLE LAMP

(71) Applicant: TOYOTA JIDOSHA KABUSHIKI KAISHA, Toyota-shi (JP)

(72) Inventor: Shuichi Aso, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/782,883

(22) Filed: Oct. 13, 2017

(65) Prior Publication Data

US 2018/0106456 A1 Apr. 19, 2018

(30) Foreign Application Priority Data

Oct. 17, 2016 (JP) ..... 2016-203722

(51) Int. Cl.
*F21S 43/245* (2018.01)
*F21S 41/24* (2018.01)

(52) U.S. Cl.
CPC ..... *F21S 43/245* (2018.01); *F21S 41/24* (2018.01)

(58) Field of Classification Search
CPC ..... F21S 43/245; F21S 43/247; F21S 43/237; F21S 43/14; F21S 41/24
See application file for complete search history.

(56) References Cited

U.S. PATENT DOCUMENTS 6,824,284 B2 * 11/2004 Chinniah ..... F21S 41/24 362/23.1
6,991,357 B2 * 1/2006 Wimbert ..... B60Q 1/302 362/603
9,738,041 B2 * 8/2017 Tatsugi ..... G02B 6/005
2003/0165017 A1 * 9/2003 Amitai ..... G02B 6/0018 359/636

(Continued)

FOREIGN PATENT DOCUMENTS

CN 1440513 A 9/2003
CN 102954417 A 3/2013

(Continued)

OTHER PUBLICATIONS

Machine English Translation (ESPACENET) of JP2012-178240A; Ryu, Hisashi (Year: 2012).*

*Primary Examiner* — Anh T Mai
*Assistant Examiner* — Glenn D Zimmerman
(74) *Attorney, Agent, or Firm* — Oblon, McClelland, Maier & Neustadt, L.L.P.

(57) ABSTRACT

There is provided a vehicle lamp, the vehicle lamp including a light source that emits light, and a light-guiding component that includes (i) a light-guiding component main body having an end portion at one end in a longitudinal direction thereof through which light from the light source is guided in and having an emission surface from which light reflected by a step portion is emitted out, and also having pairs of inclined surfaces that, when looked at in a cross-sectional (Continued)

view taken in the longitudinal direction thereof, extend on an inclination relative to the emission surface and are disposed facing each other, a plurality of the pairs of inclined surfaces being disposed in the longitudinal direction, and (ii) differential refractive index layers that are interposed between the pairs of inclined surfaces and have a lower refractive index than the refractive index of the light-guiding component main body.

4 Claims, 6 Drawing Sheets

(56) References Cited

U.S. PATENT DOCUMENTS

| | | | | |
|---|---|---|---|---|
| 2009/0256997 | A1* | 10/2009 | Misono | G02B 5/0231 349/64 |
| 2014/0211506 | A1* | 7/2014 | Nakagome | G02B 6/0036 362/613 |

FOREIGN PATENT DOCUMENTS

| | | | | |
|---|---|---|---|---|
| JP | 2008-189067 | | | 8/2008 |
| JP | 2009-509296 | A | | 3/2009 |
| JP | 2012178240 | A | * | 9/2012 |
| JP | 2014-127356 | A | | 7/2014 |
| JP | 2014127356 | A | * | 7/2014 |
| JP | 2015-133212 | | | 7/2015 |
| JP | 2015-185524 | | | 10/2015 |

* cited by examiner

VEHICLE LAMP

CROSS-REFERENCE TO RELATED APPLICATION

This application is based on and claims priority under 35 USC 119 from Japanese Patent Application No. 2016-203722 filed on Oct. 17, 2016, the disclosure of which is incorporated by reference herein.

BACKGROUND

Technical Field

The present disclosure relates to a vehicle lamp.

Related Art

A vehicle lamp that is mounted in a front portion of a vehicle is disclosed in Japanese Patent Application Laid-Open (JP-A) No. 2015-133212. This vehicle lamp is formed so as to include a light source such as an LED or the like, and a light-guiding component that guides light emitted from this light source. Moreover, the light-guiding component is formed substantially in a U-shape when seen in a vehicle front view such that light from the light source is guided in through an end portion on one side of the light-guiding component. The light emitted from the light-guiding component is visible from the vehicle front side.

In a light-guiding component in which light is guided from a light source, it is desirable for it to be possible to suppress unevenness from being generated in the brightness of the light that is emitted from the light-guiding component.

SUMMARY

The present disclosure provides a vehicle lamp that makes it possible to suppress unevenness from being generated in the brightness of emitted light.

A first aspect of the present disclosure is a lamp for a vehicle provided with a light source that emits light, and with a light-guiding component that includes (i) a light-guiding component main body having an end portion at one end in a longitudinal direction thereof through which light from the light source is guided in and having an emission surface from which light reflected by a step portion is emitted out, and also having pairs of inclined surfaces that, when looked at in a cross-sectional view taken in the longitudinal direction thereof, extend on an inclination relative to the emission surface and are disposed facing each other, and in which plural pairs of the inclined surfaces are disposed at equal distances from each other in the longitudinal direction, and (ii) differential refractive index layers that are interposed between the pairs of inclined surfaces and have a lower refractive index than the refractive index of the light-guiding component main body.

According to the above-described first aspect, light from a light source is guided onto a light-guiding component main body of the light-guiding component. After this guided light has then been reflected by a step portion, it is emitted out from an emission surface. Here, the light-guiding component main body has pairs of inclined surfaces that are inclined relative to the emission surface and are disposed facing each other. In addition to this, a differential refractive index layer having a lower refractive index than the refractive index of the light-guiding component main body is interposed between the pairs of inclined surfaces. Because of this, a portion of the light guided into the light-guiding component main body can be reflected by the boundary faces between the inclined surfaces and the differential refractive index layers. As a result, the light that is reflected by the boundary faces between the inclined surfaces and the differential refractive index layers can be emitted from the emission surface. Moreover, by causing the light that is guided into the light-guiding component main body to be reflected by the boundary faces between each of the equidistantly disposed inclined surfaces and the differential refractive index layers, it is possible to suppress unevenness from being generated in the brightness of the light emitted from the emission surface of the light-guiding component main body.

A second aspect of the present disclosure is the vehicle lamp according to the first aspect, wherein the differential refractive index layers are formed by air.

According to the above-described second aspect, by forming the differential refractive index layers from air, the light-guiding component can be formed without disposing solid differential refractive index layers.

A third aspect of the present disclosure is the vehicle lamp according to the first or second aspects, wherein projecting portions are formed on the emission surface such that the projecting portions protrude in the light emission direction.

According to the above-described third aspect, by providing the above-described projecting portions on the emission surface of the light-guiding component main body from which light from the light source is emitted out, it is possible to increase the amount of light that is emitted in the direction in which these projecting portions protrude.

The vehicle lamp according to the present disclosure makes it possible to suppress unevenness from being generated in the brightness of emitted light.

BRIEF DESCRIPTION OF THE DRAWINGS

Exemplary embodiments of the present disclosure will be described in detail based on the following figures, wherein.

DETAILED DESCRIPTION

Figure 1:
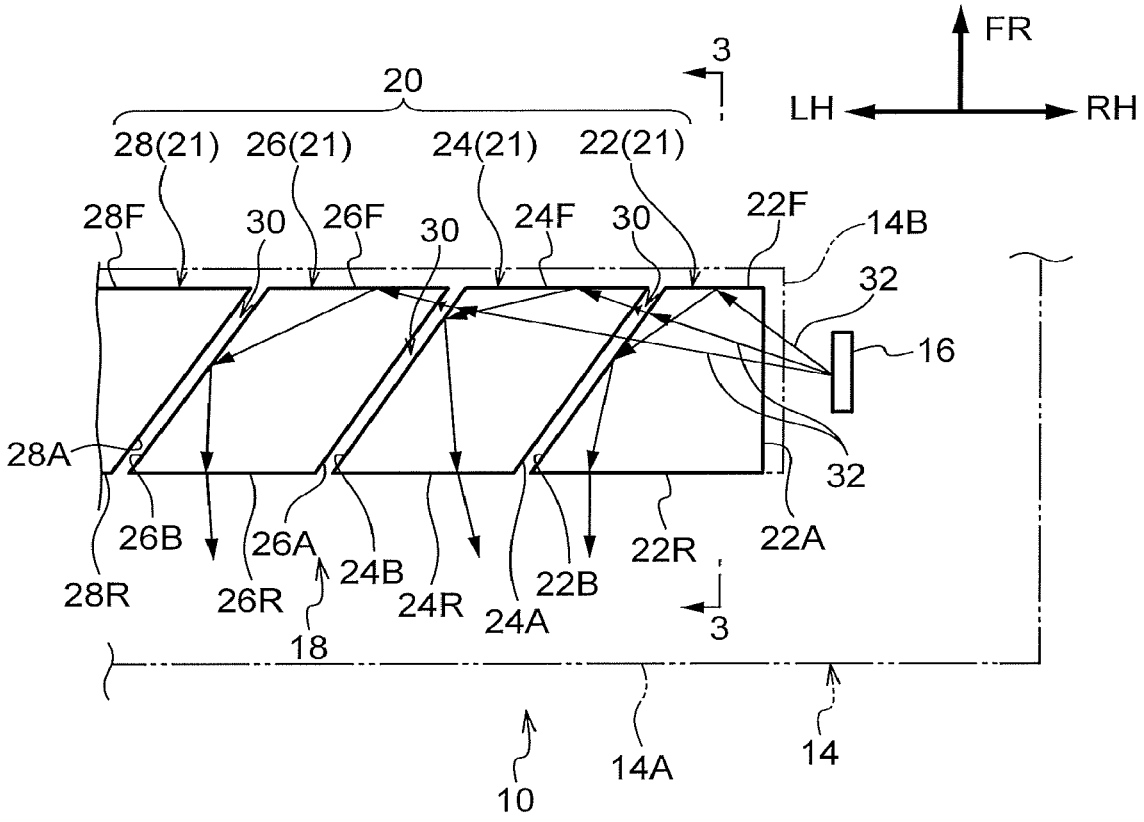
FIG. 1 is an enlarged cross-sectional view schematically showing a tail lamp according to a first exemplary embodiment taken along a line 1-1 shown in FIG. 2.

A vehicle lamp according to exemplary embodiments of the present disclosure will now be described using FIG. 1 through FIG. 3. Note that an arrow FR, an arrow UP, an arrow RH, and an arrow LH that are shown where appropriate in the drawings respectively indicate a vehicle body forward direction, a vehicle body upward direction, a vehicle body right-hand side direction, and a vehicle body left-hand side direction. Moreover, unless specifically stated otherwise, if front-rear, up-down, or left-right directions are used in the following description, then these refer respectively to the front-rear direction of the vehicle body, the vertical direction of the vehicle body, and the left and right sides in the vehicle transverse direction.

Figure 2:
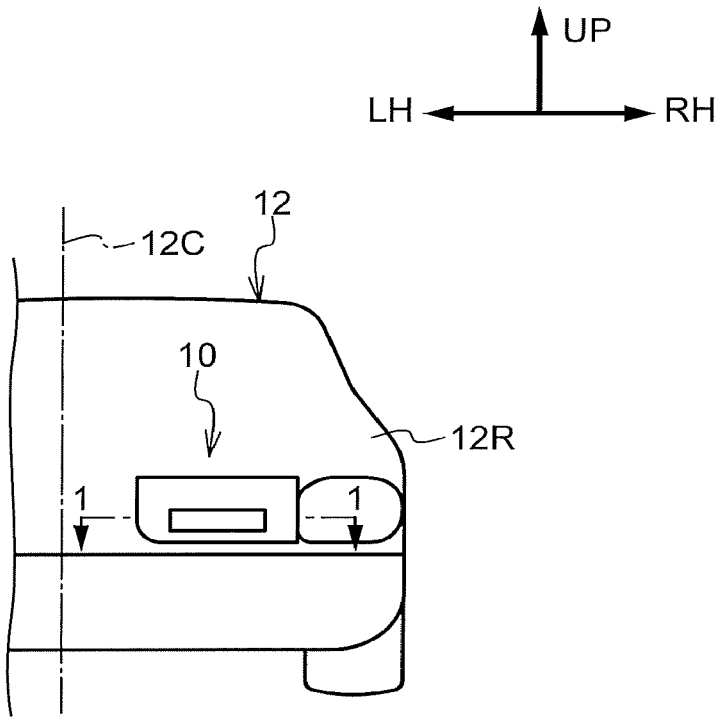
FIG. 2 is a rear view showing a vehicle provided with the tail lamp according to the first exemplary embodiment.

As is shown in FIG. 2, a tail lamp 10, which is serving as a vehicle lamp of the present exemplary embodiment, is provided on both a right side and a left side of a rear portion 12R of a vehicle 12. Note that because the tail lamp 10 that is provided on the right side of the rear portion 12R of the vehicle 12 and the tail lamp that is provided on the left side thereof are formed symmetrically in the vehicle transverse direction on either side of a center line 12C of the vehicle 12, the tail lamp 10 that is provided on the right side of the rear portion 12R of the vehicle 12 is described below.

As is shown in FIG. 1, the tail lamp 10 is formed so as to include a case 14 that forms a portion of the external outline of the tail lamp 10, a light source 16 that is disposed inside the case 14, and a light-guiding component 18 by which light emitted from the light source 16 is guided and that causes the guided light to be emitted towards the rearward side.

The case 14 is formed in the shape of a box inside which are placed the light source 16 and the light-guiding component 18, and a portion on the rearward side of this case 14 forms a transparent lens portion 14A. As a consequence, light that is emitted towards the rearward side from the light-guiding component 18 can be transmitted through the lens portion 14A. In addition, a light-guiding component main body supporting portion 14B by which a light-guiding component main body 20 of the light-guiding component 18 (described below) is supported is provided in a front side portion of the interior of the case 14.

The light source 16 is able to emit light if it is supplied with electricity. As an example, the light source 16 of the present exemplary embodiment is an LED. The light source 16 is disposed along an end portion on the right side of the light-guiding component 18 (described below) such that a light emitting direction thereof faces towards the left side (i.e., toward the inner side in the vehicle transverse direction). Note that the light source 16 is supported on a portion of the case 14.

The light-guiding component 18 is provided with the light-guiding component main body 20 whose longitudinal direction extends in the vehicle transverse direction, and that has a square-shaped cross-section when viewed from the right side and the left side. In the present exemplary embodiment, the light-guiding component main body 20 is formed using a transparent resin material, and has a divided structure which is created by dividing the light-guiding component main body 20 in the vehicle transverse direction into plural block portions 21. Note that the block portion 21 disposed furthest to the right side is taken as a first block portion 22, the block portion 21 which is disposed on the left side of the first block portion 22 is taken as a second block portion 24, the block portion 21 which is disposed on the left side of the second block portion 24 is taken as a third block portion 26, and the block portion 21 which is disposed on the left side of the third block portion 26 is taken as a fourth block portion 28. Note also that the number of blocks 21 may be suitably set in consideration of the dimensions in the vehicle transverse direction of the light-guiding component 18.

An end surface on the right side of the first block portion 22 is formed as a light incident surface 22A that extends in both the vertical and front-rear directions, and is disposed so as to face the light source 16 in the vehicle transverse direction. Light from the light source 16 enters the right-side end surface of the first block portion 22 through this light incident surface 22A. Moreover, an end surface on the left side of the first block portion 22 is formed as a planar, inclined surface 22B that, when seen in a vehicle plan view (i.e., when viewed from the upward side of the vehicle), slopes towards the left side (i.e., towards the inner side in the vehicle transverse direction) as it approaches the rearward side. Furthermore, a front surface of the first block portion 22 is formed as a first step portion 22F which serves as a step portion where a portion of the light guided into the first block portion 22 is reflected. Plural projecting portions (not shown in the drawings) are formed equidistantly in the vehicle transverse direction on the first step portion 22F. Note that, as an example, the structure of the plural projecting portions formed on the first step portion 22F is similar to the structure of the plural projecting portions 40 shown in FIG. 7.

An end surface on the right side of the second block portion 24 is formed as a planar, inclined surface 24A that, when seen in a vehicle plan view, slopes towards the left side as it approaches the rearward side, and is disposed so as to face the inclined surface 22B of the first block portion 22 at a predetermined distance therefrom. Moreover, an end surface on the left side of the second block portion 24 is formed as a planar, inclined surface 24B that, when seen in a vehicle plan view, slopes towards the left side as it approaches the rearward side. Furthermore, a front surface of the second block portion 24 is formed as a second step portion 24F which serves as a step portion where a portion of the light guided into the second block portion 24 is reflected. Plural projecting portions (not shown in the drawings) are formed equidistantly in the vehicle transverse direction on the second step portion 24F.

The structures of the third block portion 26 and the fourth block portion 28 are similar to the structure of the second block portion 24. Namely, an end surface on the right side of the third block portion 26 is formed as a planar, inclined surface 26A that, when seen in a vehicle plan view, slopes towards the left side as it approaches the rearward side, and is disposed so as to face the inclined surface 24B of the second block portion 24 at a predetermined distance therefrom. Moreover, an end surface on the left side of the third block portion 26 is formed as a planar, inclined surface 26B that, when seen in a vehicle plan view, slopes towards the left side as it approaches the rearward side. Furthermore, an end surface on the right side of the fourth block portion 28 is formed as a planar, inclined surface 28A that, when seen in a vehicle plan view, slopes towards the left side as it approaches the rearward side, and is disposed so as to face the inclined surface 26B of the third block portion 26 at a predetermined distance therefrom. Moreover, a front surface of the third block portion 26 and a front surface of the fourth block portion 28 are formed as a third step portion 26F and a fourth step portion 28F which serve as step portions where a portion of the light guided into the third block portion 26 and the fourth block portion 28 is reflected. Plural projecting portions (not shown in the drawings) are formed equidistantly in the vehicle transverse direction on the third step portion 26F and the fourth step portion 28F.

Figure 3:
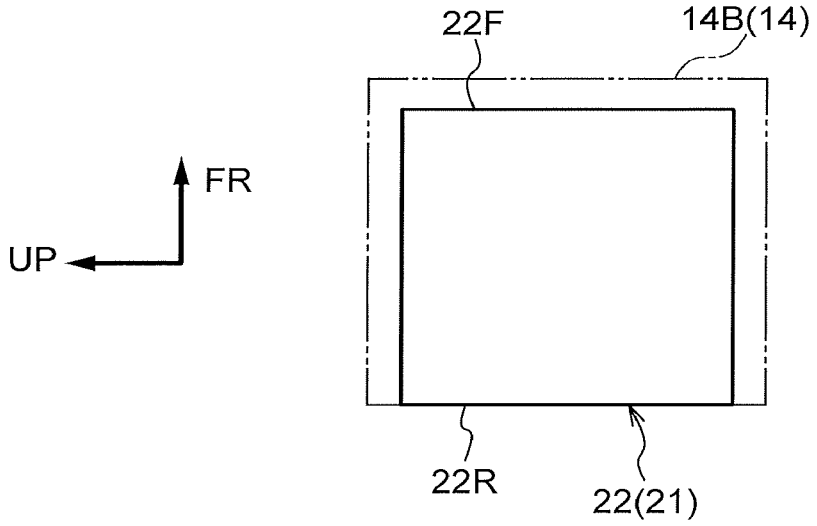
FIG. 3 is a cross-sectional view showing a mounting portion of a light-guiding component taken along a line 3-3 shown in FIG. 1.

As is shown in FIG. 1 and FIG. 3, the above-described plural block portions 21 are fixed onto the light-guiding component main body supporting portion 14B, which is open on the rearward side, such that a predetermined space is provided in the vehicle transverse direction between mutually adjacent block portions 21. As a consequence, the inclined surface 22B of the first block portion 22 and the inclined surface 24A of the second block portion 24, the inclined surface 24B of the second block portion 24 and the inclined surface 26A of the third block portion 26, and the inclined surface 26B of the third block portion 26 and the inclined surface 28A of the fourth block portion 28 are each disposed at equal distances from each other in the vehicle transverse direction. In addition, air present inside the case 14 is interposed as a differential refractive index layer between the inclined surface 22B of the first block portion 22 and the inclined surface 24A of the second block portion 24, between the inclined surface 24B of the second block portion 24 and the inclined surface 26A of the third block portion 26, and between the inclined surface 26B of the third block portion 26 and the inclined surface 28A of the fourth block portion 28. Note that the air that is interposed between each of the inclined surfaces 22B, 24A, 24B, 26A, 26B, and 28A is referred to as an air layer 30. Here, the refractive index of light in each air layer 30 is lower than the refractive index of the resin material forming the light-guiding component main body 20 (i.e., the respective block portions 21). Note that the light-guiding component 18 of the present exemplary embodiment can also be described as being formed by the light-guiding component main body 20 (i.e., the plural block portions 21) and the air layers 30.

(Operation of the Present Exemplary Embodiment)

Next, an operation of the present exemplary embodiment will be described.

As is shown in FIG. 1 and FIG. 2, when light 32 is emitted from the light source 16 as a result of a switch or the like in the vehicle 12 of the present exemplary embodiment being operated, this light 32 is guided into the first block portion 22, which forms a portion of the light-guiding component main body 20 of the light-guiding component 18, via the light incident surface 22A of this first block portion 22. A portion of the light 32 guided into the first block portion 22 is reflected by the first step portion 22F of the first block portion 22 and by the boundary face between the inclined surface 22B and the air layer 30, and is thereafter emitted towards the rearward side of the vehicle 12 via a rear surface 22R of the first block portion 22 which is serving as an emission surface.

In addition, a portion of the light 32 guided from the first block portion 22 into the second block portion 24 is reflected by the second step portion 24F of the second block portion 24 and by the boundary face between the inclined surface 24B and the air layer 30, and is thereafter emitted towards the rearward side of the vehicle 12 via a rear surface 24R of the second block portion 24 which is serving as an emission surface.

Furthermore, a portion of the light 32 guided from the second block portion 24 into the third block portion 26 is reflected by the third step portion 26F of the third block portion 26 and by the boundary face between the inclined surface 26B and the air layer 30, and is thereafter emitted towards the rearward side of the vehicle 12 via a rear surface 26R of the third block portion 26 which is serving as an emission surface. Note that, in the same way as this, a portion of the light 32 guided from the third block portion 26 into the fourth block portion 28 is also emitted towards the rearward side of the vehicle 12 via a rear surface 28R of the fourth block portion 28 which is serving as an emission surface As has been described above, in the tail lamp 10 of the present exemplary embodiment, light from the light source 16 can be emitted towards the rearward side of the vehicle 12 via the light-guiding component 18.

Here, in the present exemplary embodiment, mutually facing surfaces of pairs of blocks 21 that are mutually adjacent in the left-right direction are formed as inclined surfaces (i.e., the inclined surfaces 22B, 24A, 24B, 26A, 26B, and 28A), and the air layers 30 are interposed between the mutually facing pairs of inclined surfaces. As a consequence, the light that is guided into each of the block portions 21 can be reflected at the positions of each one of the inclined surfaces. As a result, it is possible to suppress unevenness from being generated in the brightness of the light that is emitted from the light-guiding component 18 towards the vehicle rear side. Note that brightness unevenness refers to the brightness of the light being dispersed sporadically without any regularity being applied thereto.

Figure 7:
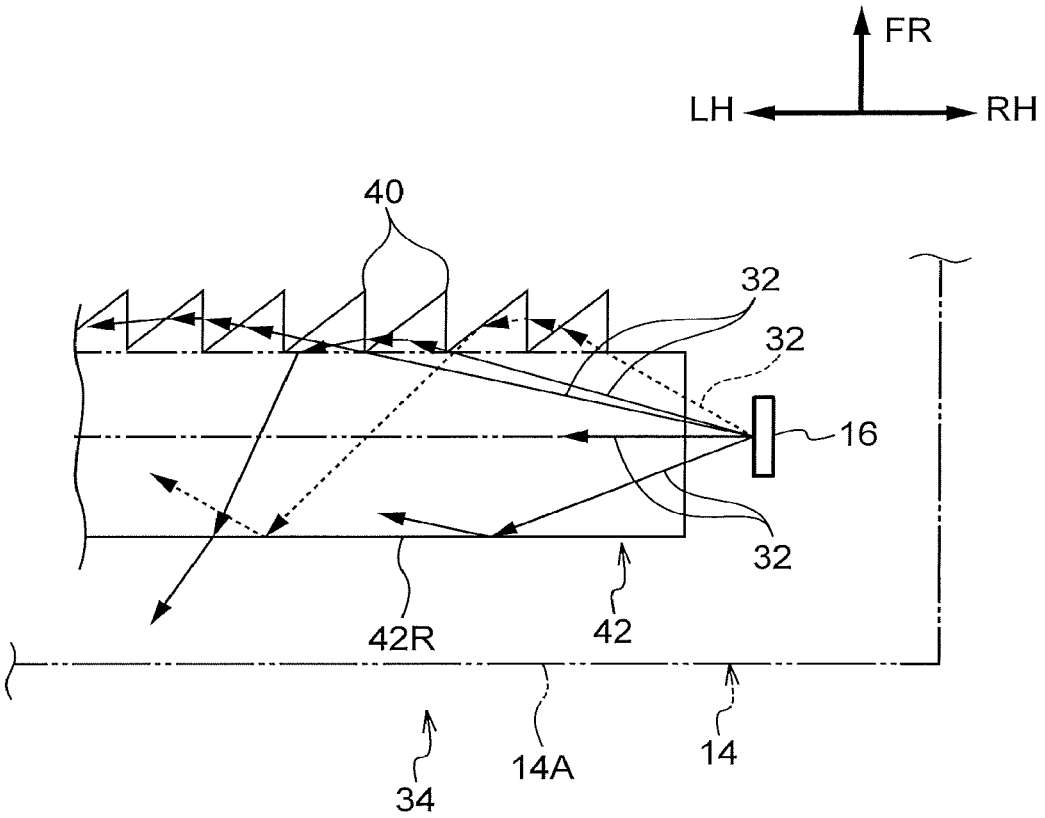
FIG. 7 is an enlarged cross-sectional view corresponding to FIG. 1 schematically showing a tail lamp according to a comparative example.

Moreover, in the present exemplary embodiment, by employing a structure in which the air layers 30 are interposed between the mutually facing pairs of inclined surfaces (i.e., the inclined surfaces 22B, 24A, 24B, 26A, 26B, and 28A), it is possible to form the tail lamp 10 without having to interpose any other component between the mutually facing pairs of inclined surfaces. In contrast to this, as is shown in FIG. 7, in a tail lamp 38 according to a comparative example, the above-described air layers 30 are not provided. Because of this, a greater distance is required for light to be transmitted through the plural projecting portions 40 that are serving as step portions. As a result, portions where it is difficult for the light 32 that is reflected by the plural step portions 40 to be emitted from a rear surface 42R of a light-guiding component 42 that is serving as an emission surface, and portions where it is easy for this light 32 to be emitted therefrom are generated, and it is easy for unevenness to be generated in the brightness of the light 32 that is emitted from this rear surface 42R.

Note that it is also possible to insert a resin material having a lower refractive index than the refractive index of the resin material forming the light-guiding component main body 20 (i.e., the respective block portions 21) between the mutually facing pairs of inclined surfaces as a differential refractive index layer, instead of the air layers 30.

Figure 4:
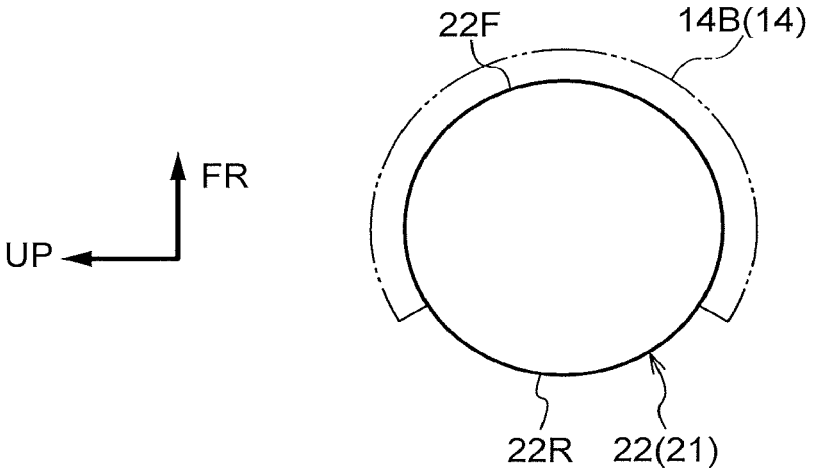
FIG. 4 is a cross-sectional view corresponding to FIG. 3 showing a light-guiding component and a mounting portion thereof according to a first variant example.
Figure 5:
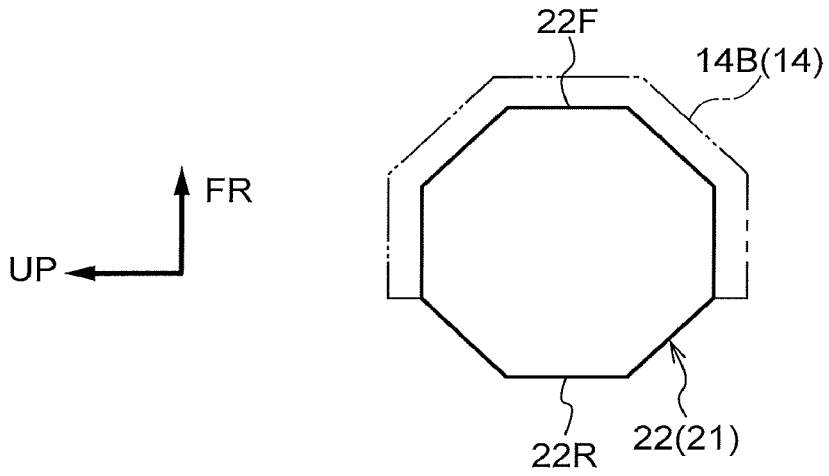
FIG. 5 is a cross-sectional view corresponding to FIG. 3 showing a light-guiding component and a mounting portion thereof according to a second variant example.

Moreover, in the present exemplary embodiment, the tail lamp 10 is formed using a light-guiding component main body 20 (i.e., the plural block portions 21) having a square-shaped cross-section when viewed from the right side and the left side, however, the present disclosure is not limited to this. For example, as is shown in FIG. 4 and FIG. 5, it is also possible to form the tail lamp 10 using a light-guiding component main body 20 (i.e., the plural block portions 21) having a circular cross-section or having a polygonal cross-section when viewed from the right side and the left side. In this manner, the cross-sectional configuration of the light-guiding component main body 20 may be appropriately set in consideration of the design aspect and the like of the tail lamp 10. Moreover, the plural block portions 21 may also be formed such that a portion of each block portion is connected to another block portion.

(Tail Lamp 34 According to a Second Exemplary Embodiment)

Next, a tail lamp 34 serving as a vehicle lamp according to a second exemplary embodiment of the present disclosure will be described using FIG. 6. Note that components and portions that correspond to the tail lamp 10 according to the above-described first exemplary embodiment are given the same descriptive symbols as in the above-described exemplary embodiment and any description thereof is omitted.

Figure 6:
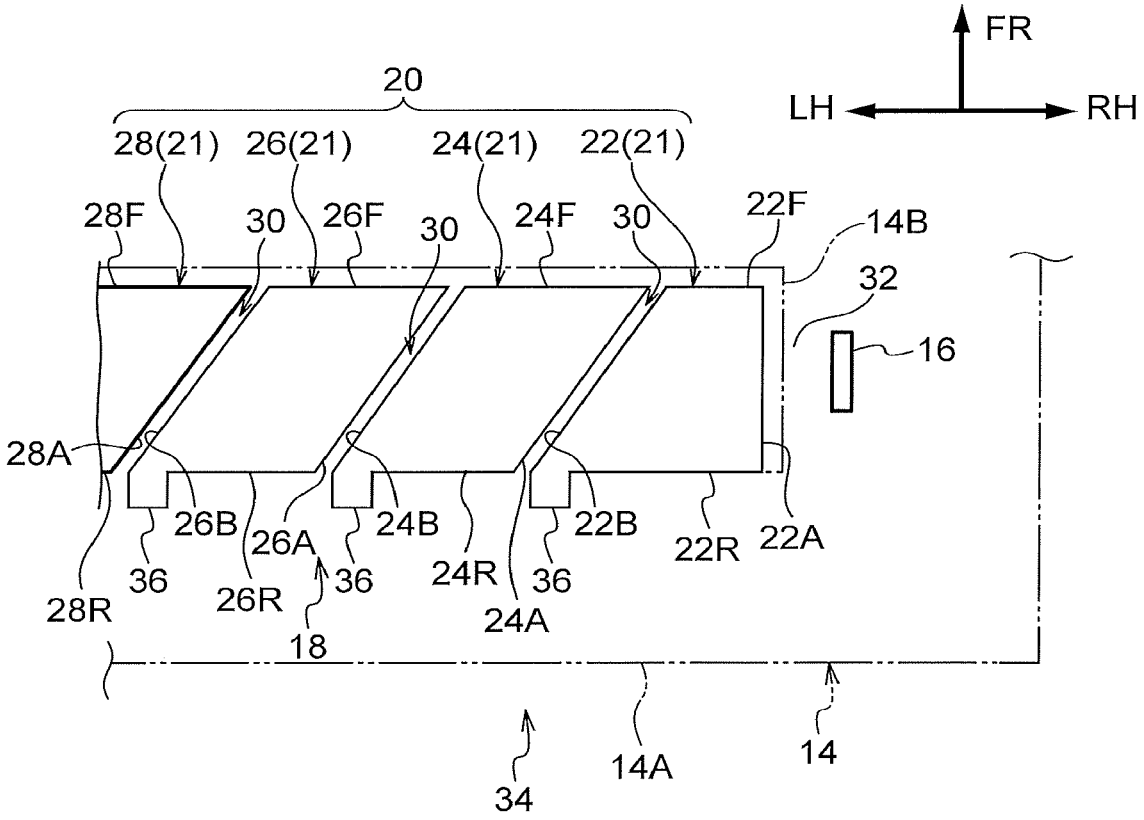
FIG. 6 is an enlarged cross-sectional view corresponding to FIG. 1 schematically showing a tail lamp according to a second exemplary embodiment.

As is shown in FIG. 6, the tail lamp 34 of the present exemplary embodiment has the feature that projecting portions 36 are formed protruding towards the rearward side from an end portion on the left side (i.e., an end portion on the inner side in the vehicle transverse direction) of each block portion 21. In the tail lamp 34 of the present exemplary embodiment, it is possible to increase the amount of light that is emitted in the direction in which the projecting portions 36 formed on the respective block portions 21 protrude. As a consequence, the brightness of the light emitted from the portions that correspond to the projecting portions 36 can be increased compared to the brightness of the light emitted from the portions where the projecting portions 36 are not formed.

Note that the present disclosure is not limited to the tail lamps 10 and 34, and may also be applied to other vehicle lamps such as head lamps and back lamps.

Exemplary embodiments of the present disclosure have been described and illustrated above, however, it is to be understood that the present disclosure is not limited to the foregoing exemplary embodiments and various modifications and the like may be made to the above-described structure insofar as they do not depart from the spirit or scope of the present disclosure.

What is claimed is:

1. A vehicle lamp comprising:

a light source that emits light; and a light-guiding component that includes a plurality of block portions, wherein each of the block portions includes:

a light-guiding component main body having a first inclined surface at a first end in a longitudinal direction thereof through which light from the light source is guided in, a step portion that reflects the guided light, a second inclined surface at a second end in the longitudinal direction thereof that, when looked at in a cross-sectional view taken in the longitudinal direction thereof, extends on an inclination relative to the step portion, is disposed facing the first inclined surface, and reflects the light reflected by the step portion as a substantially total reflection, and an emission surface from which the light reflected by the second inclined surface is emitted, and a differential refractive index layer that is adjacent to the second inclined surface, and has a lower refractive index than the refractive index of the light-guiding component main body, wherein a plurality of pairs of the second inclined surface and the first inclined surface in adjacent block portions are disposed at equal distances from each other in the longitudinal direction of the light-guiding component, and the differential refractive index layer is interposed between the pair of the second inclined surface and the first inclined surface in adjacent block portions, and wherein the light source is disposed along a longitudinal end portion of the light-guiding component and between the step portions and the emission surfaces of the light-guiding component main bodies in a direction perpendicular to the longitudinal direction.

2. The vehicle lamp according to claim 1, wherein the differential refractive index layer is formed by air.

3. The vehicle lamp according to claim 1, wherein a projecting portion formed on the emission surface such that the projecting portion protrudes in a light emission direction.

4. The vehicle lamp according to claim 1, comprising four block portions.

* * * * *